US012644351B1

(12) United States Patent
Thangarajoo et al.

(10) Patent No.: US 12,644,351 B1
(45) Date of Patent: Jun. 2, 2026

(54) PRESSURE INTENSIFIER FOR HYDRAULICALLY SETTING A DOWNHOLE TOOL

(71) Applicant: Halliburton Energy Services, Inc., Houston, TX (US)

(72) Inventors: Sooriyah Thangarajoo, Singapore (SG); Jalpan P. Dave, Singapore (SG); Ryan T. Humphrey, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/174,967

(22) Filed: Apr. 10, 2025

(51) Int. Cl.
*E21B 23/10* (2006.01)
*E21B 23/04* (2006.01)

(52) U.S. Cl.
CPC ..... *E21B 23/10* (2013.01); *E21B 23/0416* (2020.05)

(58) Field of Classification Search
CPC ..... E21B 23/10; E21B 23/0416
See application file for complete search history.

(56) References Cited

U.S. PATENT DOCUMENTS 4,545,433 A 10/1985 Wambaugh
5,429,036 A 7/1995 Latos
5,893,413 A * 4/1999 Lembcke ..... E21B 23/0411 166/321
6,073,708 A 6/2000 Brown et al.
6,289,998 B1 9/2001 Krueger et al.
(Continued)

FOREIGN PATENT DOCUMENTS

BR 112021007440 7/2021
GB 2552994 2/2018
(Continued)

OTHER PUBLICATIONS

"U.S. Appl. No. 18/407,842 Filed Application and Drawings", Jan. 9, 2024, 76 pages.
(Continued)

*Primary Examiner* — Nicole Coy
*Assistant Examiner* — Nicholas D Wlodarski
(74) *Attorney, Agent, or Firm* — DeLizio, Peacock, Lewin & Guerra LLP

(57) ABSTRACT

A downhole tool and a method of moving the downhole tool between a radially retracted state and a fully radially expanded state. The downhole tool includes a mandrel, and a pressure intensifier positioned radially about the mandrel, the pressure intensifier including a first piston having a first pressure receiving end with a piston surface area (A1) and a first pressure output end with a piston surface area (A2), where A1 is greater than A2; a second piston having a second pressure receiving end with a piston surface area (A3), where A3 is greater than A2; a piston cylinder radially encompassing the first and second pistons; a fluid chamber defined between the first pressure output end of the first piston, the second pressure receiving end of the second piston, and the piston cylinder, the fluid chamber fluidly coupling the first pressure output end of the first piston to the second pressure receiving end of the second piston; and a pressure relief system, wherein the pressure relief system evacuates fluid from the fluid chamber when pressure in the fluid chamber rises above a pressure relief system threshold.

20 Claims, 9 Drawing Sheets

(56) References Cited

U.S. PATENT DOCUMENTS

| | | | | |
|---|---|---|---|---|
| 7,000,705 | B2 | 2/2006 | Buyers et al. | |
| 9,383,029 | B2 | 7/2016 | Scott | |
| 9,551,200 | B2 | 1/2017 | Read et al. | |
| 10,066,466 | B2 | 9/2018 | Radtke | |
| 10,132,135 | B2 | 11/2018 | Gaude | |
| 2005/0034876 | A1 | 2/2005 | Doane et al. | |
| 2005/0230122 | A1* | 10/2005 | Cho | E21B 23/042 166/381 |
| 2011/0100645 | A1* | 5/2011 | Yapici | E21B 23/0421 166/373 |
| 2011/0232474 | A1 | 9/2011 | Geiger | |
| 2014/0190708 | A1* | 7/2014 | Hallundbaek | E21B 33/1277 166/207 |
| 2014/0216755 | A1* | 8/2014 | Hallundaek et al. | E21B 33/127 166/387 |
| 2016/0177658 | A1 | 6/2016 | Lee | |
| 2018/0080303 | A1 | 3/2018 | Radtke et al. | |
| 2021/0047893 | A1 | 2/2021 | Hrupp et al. | |
| 2021/0363844 | A1 | 11/2021 | Roane et al. | |
| 2022/0090457 | A1 | 3/2022 | Tanguy et al. | |

FOREIGN PATENT DOCUMENTS

| | | |
|---|---|---|
| WO | 1999035365 | 7/1999 |
| WO | 2016051180 | 4/2016 |

OTHER PUBLICATIONS

"U.S. Appl. No. 18/407,842 Non Final Office Action", Dec. 6, 2024, 20 pages.

Bartnicki, et al., "The Research of Hydraulic Pressure Intensifier for Use in Electric Drive System", IEEE Access, 2018, 2018, 6 pages.

"PCT Application No. PCT/US2025/025276 International Search Report and Written Opinion", Jan. 7, 2026, 10 pages.

* cited by examiner

PRESSURE INTENSIFIER FOR HYDRAULICALLY SETTING A DOWNHOLE TOOL

BACKGROUND

A typical downhole tool (e.g., packer, bridge plug, frac plug, anchor, etc.) generally has one or more radially extending elements that are employed to provide a fluid-tight seal or anchor radially between a mandrel of the downhole tool, and the casing or wellbore into which the downhole tool is disposed. Such a downhole tool is commonly conveyed into a subterranean wellbore suspended from tubing extending to the earth's surface.

To prevent damage to the radially extending elements of the downhole tool while the downhole tool is being conveyed into the wellbore, the radially extending elements may be carried on the mandrel in a retracted or uncompressed state, in which they are radially inwardly spaced apart from the casing. When the downhole tool is set, the radially extending elements radially expand, thereby providing the fluid-tight seal or anchor between the mandrel and the casing and/or wellbore.

BRIEF DESCRIPTION OF THE DRAWINGS

Embodiments of the disclosure may be better understood by referencing the accompanying drawings.

Like reference numbers and designations in the various drawings indicate like elements.

DETAILED DESCRIPTION

Figure 1:
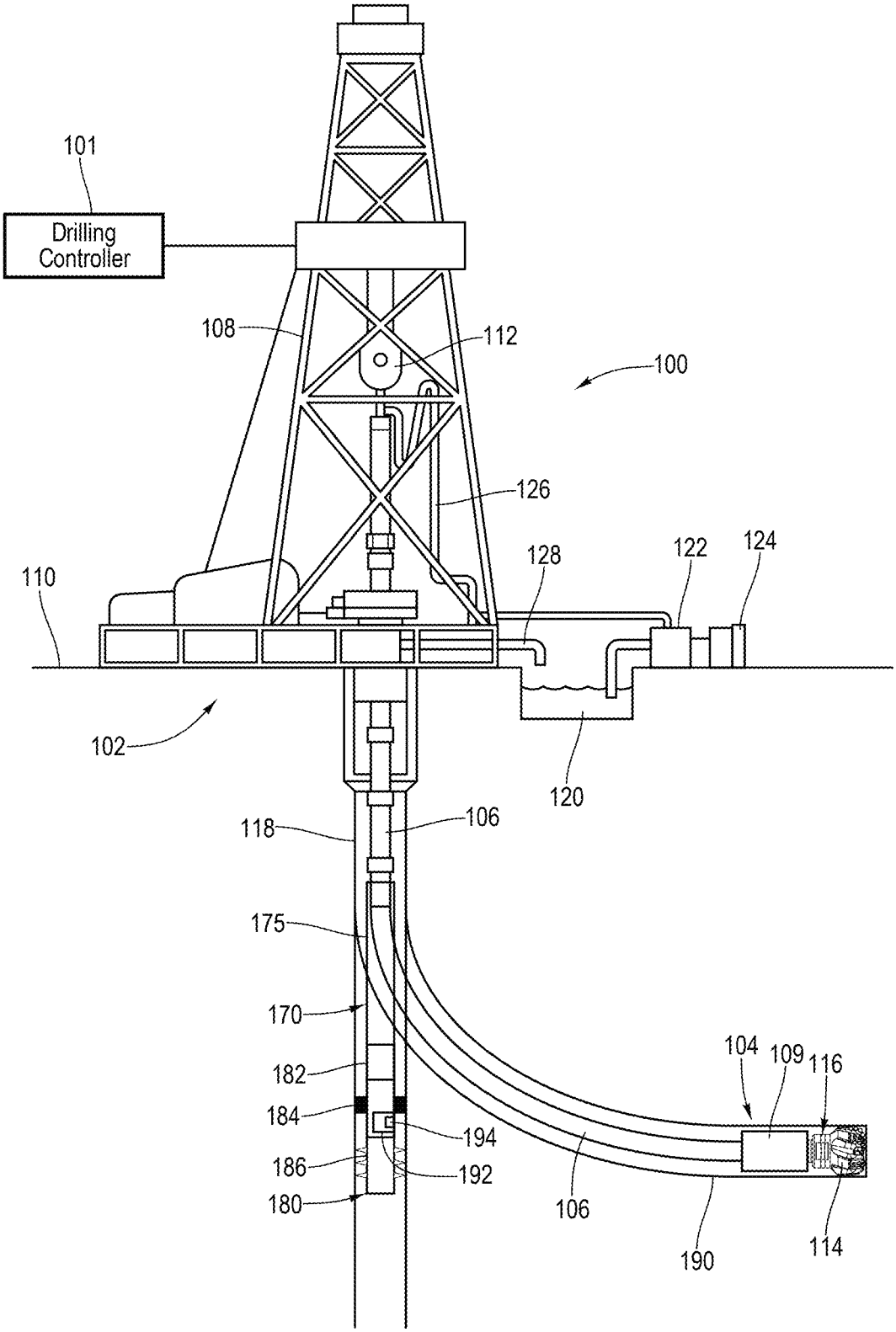
FIG. 1 is an elevation view in partial cross section of an example well system that supports deployment of downhole tools, according to aspects of the present disclosure.

The description that follows includes example systems, methods, techniques, and program flows that embody embodiments of the disclosure. Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Sliding elements are traditionally a critical part of a downhole tool, such as a sealing assembly, anchoring assembly, and/or valve assembly, among others. In some example approaches, a hydraulic setting force may be used to hydraulically move the sliding elements of such downhole tools (e.g., setting the radially extending elements of a sealing assembly or anchoring assembly) into position. The hydraulic setting force may, therefore, be a design limitation. For instance, surface equipment coupled to the sliding element may be limited in the amount of hydraulic setting force it can provide, and the limited amount of hydraulic setting force may be insufficient to fully deploy the sliding element (e.g., sealing assembly, anchoring assembly, or valve assembly). In another example, surface equipment coupled to the sliding element may be able to provide sufficient hydraulic setting force to the sliding element but the amount provided to the sliding element may be intentionally reduced so as to not prematurely shear other wellbore features (e.g., shear features, collets, etc. located within the wellbore), such as might be the case if too high of a setting pressure is applied to deploy the sliding element (e.g., sealing assembly, anchoring assembly, or valve assembly).

There are various ways to increase inadequate hydraulic setting pressure at the sliding element. In one approach, one or more pistons operating together may be used to increase an inadequate hydraulic setting force to a level sufficient to provide sufficient hydraulic setting force to the sliding element. Such an approach may, however, increase the cost and length of the piston assembly.

In another approach, a pressure intensifier may be added to a traditional hydraulic setting mechanism to provide higher localized pressures (e.g., for a given applied pressure) than traditionally achievable. In one example approach, a pressure intensifier, as disclosed herein, employs a first piston having different surface areas at a pressure receiving end and a pressure output end thereof, connected to a second piston having a second larger surface area. For example, the pressure receiving end of the first piston might have a larger surface area (A1) and the pressure output end of the first piston might have a smaller surface area (A2). The pressure output end of the first piston having the smaller surface area (A2) may then be coupled to the second piston having a second larger surface area (A3), for example via an incompressible fluid.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Example Well System

FIG. 1 is an elevation view in partial cross section of an example well system that supports directional drilling, according to aspects of the present disclosure. In the example shown in FIG. 1, the well system 100 includes a drilling controller 101 used to direct a drill bit 114 (in drilling a wellbore 118 through a subterranean formation 102, such as a subsea well or a land well. Example embodiments are not limited to only drilling an oil well. Some implementations may also encompass natural gas wellbores, other hydrocarbon wellbores, or wellbores in general. Further, some implementations may be used for the exploration and formation of geothermal wellbores intended to provide a source of heat energy instead of hydrocarbons.

In the example shown in FIG. 1, well system 100 includes a drill string 106 attached to a derrick 108 and a bottom hole assembly (BHA) 104; the BHA 104 may be positioned or otherwise arranged at the bottom of the drill string 106. The derrick 108 may be located at the surface 110 and may, in some example approaches, include a kelly 112 connected to drill string 106; the kelly 112 may be used, for instance, to lower and raise the drill string 106.

The BHA 104 may include a drill bit 114, a rotary steerable system (RSS) 109, other suitable components, or a combination thereof. The drill bit 114 may, in some examples, be operatively coupled to a tool string 116, with the tool string 116 attached to the drill string 106 such that the drill bit 114 may be moved axially within drilled wellbore 118. During operation, the drill bit 114 can penetrate the subterranean formation 102 to extend the wellbore 118.

The BHA 104 may control the drill bit 114 as the BHA 104 advances into the subterranean formation 102. For example, the BHA 104 may use the rotary steerable system 109 to change a direction of drilling by applying a steering pressure or other suitable force to a wall of the wellbore 118.

In the example shown in FIG. 1, fluid such as a drilling mud may be pumped downhole from a mud tank 120 using a mud pump 122 that may be powered by an adjacent power source, such as a prime mover (or motor) 124. The mud may be pumped from the mud tank 120, through a standpipe 126, which feeds the mud through the drill string 106 to the rotary steerable system 109, or other suitable components of the well system 100, and on to the drill bit 114. The mud may, in some examples, exit one or more nozzles (not shown) arranged in the drill bit 114 and may thereby cool the drill bit 114. Additionally or alternatively, the mud may be directed (e.g., as pressurized mud) into the rotary steerable system 109 for adjusting a direction of the drill bit 114, as discussed in further detail below.

After exiting the drill bit 114 or other suitable component, the mud may circulate back to the surface 110 via an annulus defined between the wellbore 118 and the drill string 106. The returning mud transports cuttings from the wellbore 118 into the mud tank 120 and aids in maintaining the integrity of the wellbore 118. For example, cuttings and mud mixture passed from the annulus through the flow line 128 may be processed such that a cleaned mud is returned down hole through the standpipe 126.

The tool string 116 may include one or more logging while drilling (LWD) or measurement-while-drilling (MWD) tools that collect data and measurements relating to various borehole and formation properties as well as the position of the drill bit 114 and various other drilling conditions as the drill bit 114 extends the wellbore 118 through the formation 102. The Logging While Drilling (LWD)/(MWD) tools may include a device for measuring formation resistivity, a gamma ray device for measuring formation gamma ray intensity, devices for measuring the inclination and azimuth of the BHA 104, pressure sensors for measuring drilling fluid pressure, temperature sensors for measuring borehole temperature, etc.

In the example shown in FIG. 1, RSS 109 is configured to change the direction of the tool string 116 and/or the drill bit 114, such as based on information indicative of tool orientation and a desired drilling direction received from a drilling application. In one or more example approaches, the RSS 109 is coupled to the drill bit 114 and may drive rotation of the drill bit 114. Specifically, the RSS 109 may rotate in tandem with the drill bit 114 or may rotate at a fraction of the rate of drill bit 114. In some implementations, the rotary steerable system 109 may be a point-the-bit system or a push-the-bit system.

In the example well system of FIG. 1, wellbore 118 is a "main" wellbore that has been drilled through the various earth strata, including the subterranean formation 102. The term "main" wellbore is used herein to designate a wellbore from which another wellbore is drilled. It is to be noted, however, that a main wellbore 118 does not necessarily extend directly to the earth's surface but could instead be a branch of yet another wellbore. A casing string (not shown) may be at least partially cemented within the main wellbore 118. The term "casing" is used herein to designate a tubular string used to line a wellbore. Casing may be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the example approach of FIG. 1, a whipstock assembly 170 is positioned at a location in the main wellbore 118. Specifically, the whipstock assembly 170 could be placed at a location in the main wellbore 118 where it is desirable for a lateral wellbore 190 to exit. Accordingly, the whipstock assembly 170 may be used to support a milling tool used to penetrate a window in the main wellbore 118, and once the window has been milled and a lateral wellbore 190 formed, in some example approaches, the whipstock assembly 170 may be retrieved and returned uphole by a retrieval tool.

The whipstock assembly 170, in at least one example approach, includes a whipstock element section 175, as well as a sealing/anchoring assembly 180 coupled to a downhole end thereof. The sealing/anchoring assembly 180, in one or more example approaches, includes an orienting receptacle tool assembly 182, a sealing assembly 184, and an anchoring assembly 186. The orienting receptacle tool assembly 182, in one or more example approaches, along with a collet and one or more orienting keys, may be used to land and position a guided milling assembly and/or the whipstock element section 175 within the main wellbore 118. The sealing assembly 184, in at least one example approach, seals (e.g., provides a pressure tight seal) an annulus between the whipstock assembly 170 and the main wellbore 118. In at least one example approach, the anchoring assembly 186 axially, and optionally rotationally, fixes the whipstock assembly 170 within the main wellbore 118.

The elements of the whipstock assembly 170 may be positioned within the main wellbore 118 in one or more separate steps. In at least one example approach, the sealing/anchoring assembly 180, including the orienting receptacle tool assembly 182, sealing assembly 184 and the anchoring assembly 186, may be run in hole first, and then set within main wellbore 118. The sealing assembly 184 may then be pressure tested. The whipstock element section 175 may then be run in hole and coupled to the sealing assembly 184, for example using the orienting receptacle tool assembly 182, resulting in the whipstock assembly 170 shown in FIG. 1.

In the example approach shown in FIG. 1, the sealing assembly 184 may be located within an open-hole section of the wellbore 118. In other example approaches, however, the sealing assembly 184 may be located within a casing or other tubular element (not shown).

In one or more example approaches, the sealing assembly 184 includes a pressure intensifier 192 designed, manufactured and/or operated according to one or more example approaches of the disclosure. In one or more such example approaches, the pressure intensifier includes a pressure relief system 194 as described in further detail below.

Figure 2:
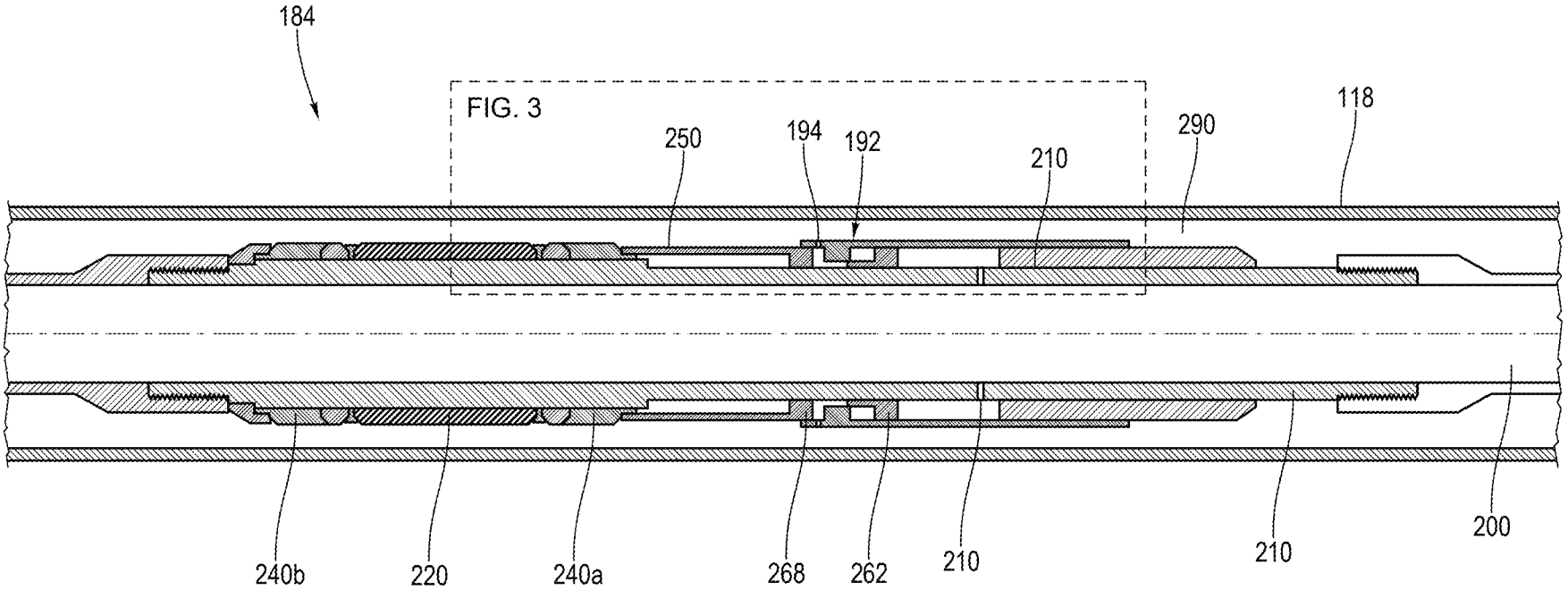
FIG. 2 is a cross-sectional view of a deployment state of an example sealing/anchoring assembly that may be used in the example well system of FIG. 1, according to aspects of the present disclosure.

FIG. 2 is a cross-sectional view of a deployment state of an example sealing assembly that may be used in the example well system of FIG. 1, according to aspects of the present disclosure. In the example shown in FIG. 2, sealing assembly 184 includes a mandrel 210. The mandrel 210, in the illustrated example, may be centered about a centerline (CL) of tubing 200. The mandrel 210, in one or more example approaches, is a tubular mandrel such as an inner tubular placed to create an annulus 290 within wellbore 118. In some example approaches the wellbore 118 is an open-hole wellbore. In some example approaches the wellbore 118 includes a casing (not shown); the sealing assembly 184 seals the casing when deployed. The wellbore 118, in at least one other example, is an outer tubular positioned within a wellbore, such as casing, production tubing, or other tubular element.

In the example approach shown in FIG. 2, the sealing assembly 184 includes a sealing element 220 (e.g., an elastomeric sealing element). The sealing element 220, in one or more example approaches, is operable to move between a radially retracted state, such as that shown in FIGS. 2, 3, 6 and 7, a first radially expanded state, such as that shown in FIG. 4 (a partially radially expanded state), and a second radially expanded state, such as that shown in FIG. 5 (a fully radially expanded state). While a single sealing element 220 is illustrated in FIG. 2, in other example approaches, two or more sealing elements 220 are employed, whether together or spaced apart in series along the mandrel 210. In one example approach, the sealing element 220 may include a non-swellable elastomer, among other types and materials.

In some example approaches, as shown in FIG. 2, first and second collar sleeves (240*a*, 240*b*) straddle ends of the sealing element 220. In some example approaches, sealing element 220 includes an anchor element that includes one or more anchoring features thereon (such as, for example, the anchor elements shown in anchoring assembly 186 in FIG. 1).

In the example approaches shown in FIGS. 2-7, a sliding element 250 (e.g., an axial sliding element) is positioned radially about the mandrel 210 and is coupled with a first end of the sealing element 220. In one or more example approaches, the first collar sleeve 240*a* and the sliding element 250 are a single combined feature, as opposed to the multiple separate features shown in FIGS. 2 through 7.

Figure 4:
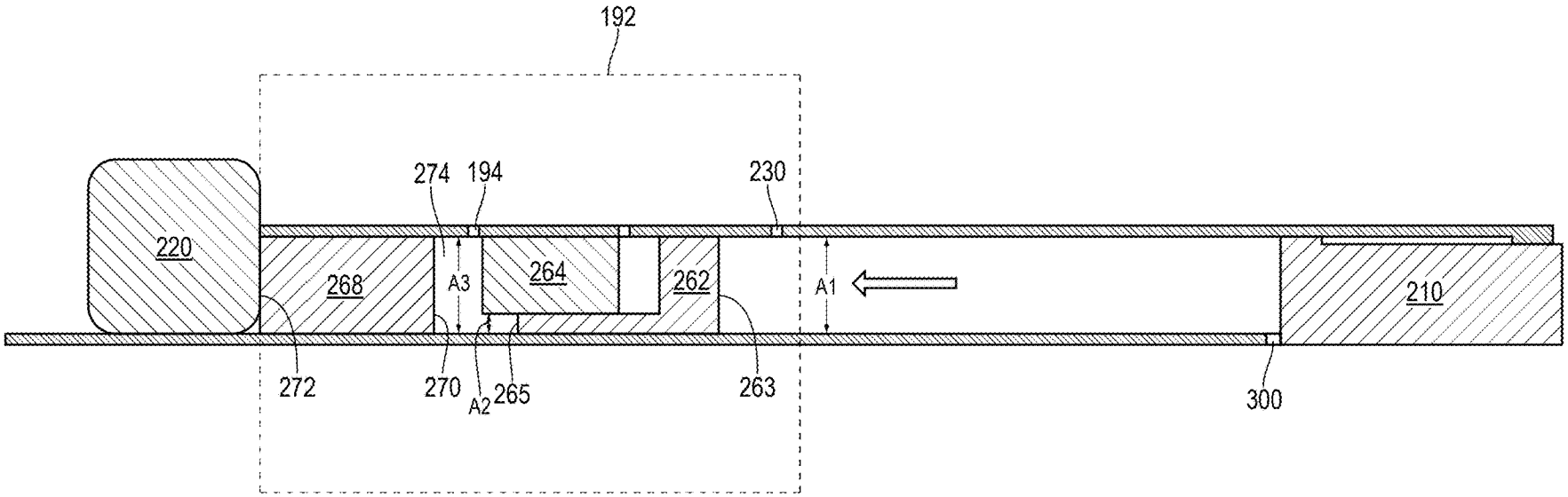
FIG. 4 is a quarter section views of deployment states of an example sealing assembly that may be used in the example well system of FIG. 1, according to aspects of the present disclosure.
Figure 5:
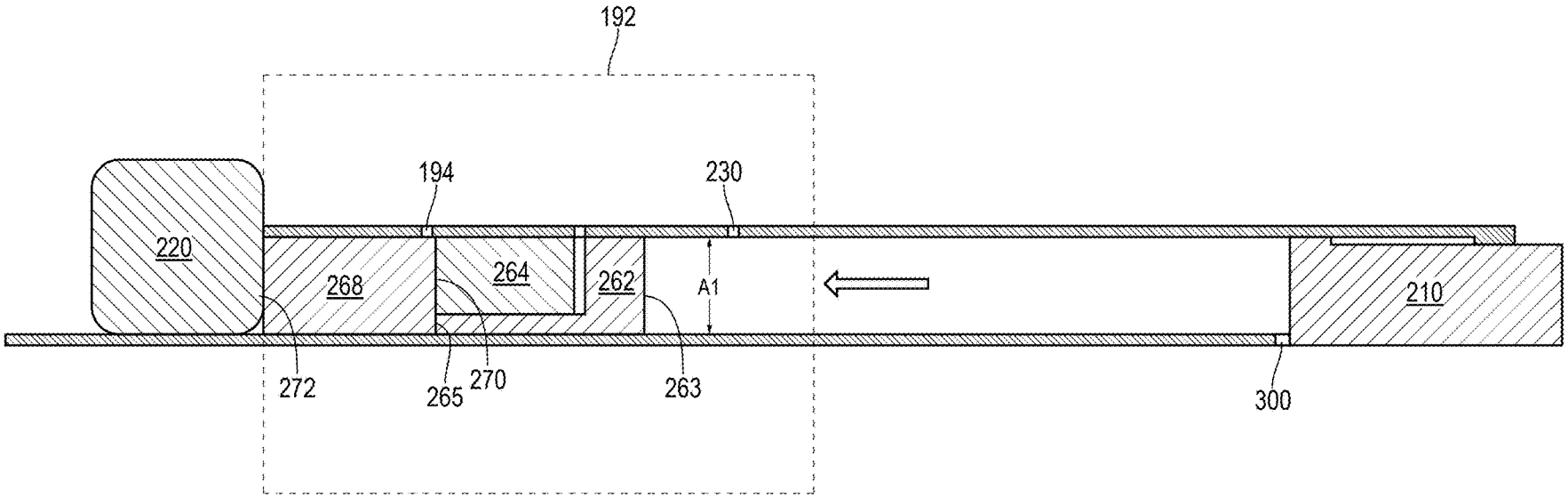
FIG. 5 is quarter section view of an example sealing assembly where the pressure relief system has evacuated the fluid from the fluid chamber, according to aspects of the present disclosure.

In one example approach of FIG. 2, the first and second collar sleeves (240*a*, 240*b*) are configured to axially slide relative to one another to move the sealing element 220 between the radially retracted state, such as that shown in FIGS. 2, 3, 6 and 7, the first radially expanded state (the partially radially expanded state such as that shown in FIG. 4), and the second radially expanded state (the fully radially expanded state such as that shown in FIG. 5). In some example approaches, one or more anti-extrusion devices such as shoes (not shown) may be used on the sealing assembly 184.

In example approaches shown in FIGS. 2-7, the sealing assembly 184 additionally includes a pressure intensifier 192 positioned radially about the mandrel 210 and coupled in some examples to the sliding element 250. In some example approaches, the pressure intensifier 192 may include a first piston 262 (e.g., primary piston) coupled to a second piston 268. The first piston 262 has a first pressure receiving end 263 with a larger piston surface area (A1) and a first pressure output end 265 with a smaller piston surface area (A2). The second piston 268 has a second pressure receiving end 270 with a larger piston surface area (A3). In the example shown in FIGS. 2-7, a second end 272 of the second piston 268 may be coupled to sealing element 220 or may be coupled with sealing element 220 through a mechanism such as sliding element 250. In at least one example approach, the second piston 268 of the pressure intensifier 192 is in a same force path as the first piston 262 of the pressure intensifier 192, and in the same force path as the sliding element 250. In at least one example approach, the second piston 268 of the pressure intensifier 192 is in a same force path as the first piston 262 of the pressure intensifier 192, and in the same force path as the sealing element 220.

In the examples shown in FIGS. 2-7, the first pressure receiving end 263 is shown to be in communication with the interior of sealing assembly 184 via a setting port 280. In other example approaches, a control line operated tool, a tool operated using a downhole pump, actuator or other power source may be used to apply setting pressure to first pressure receiving end 263. In other example approaches, the pressure receiving end 263 may initially be isolated from any pressure or power source using devices such as a burst disc. When it is desired to actuate the tool, the burst disk may be ruptured by applied pressure or other means, allowing the wellbore hydrostatic pressure to set the sealing element 220.

Figure 3:
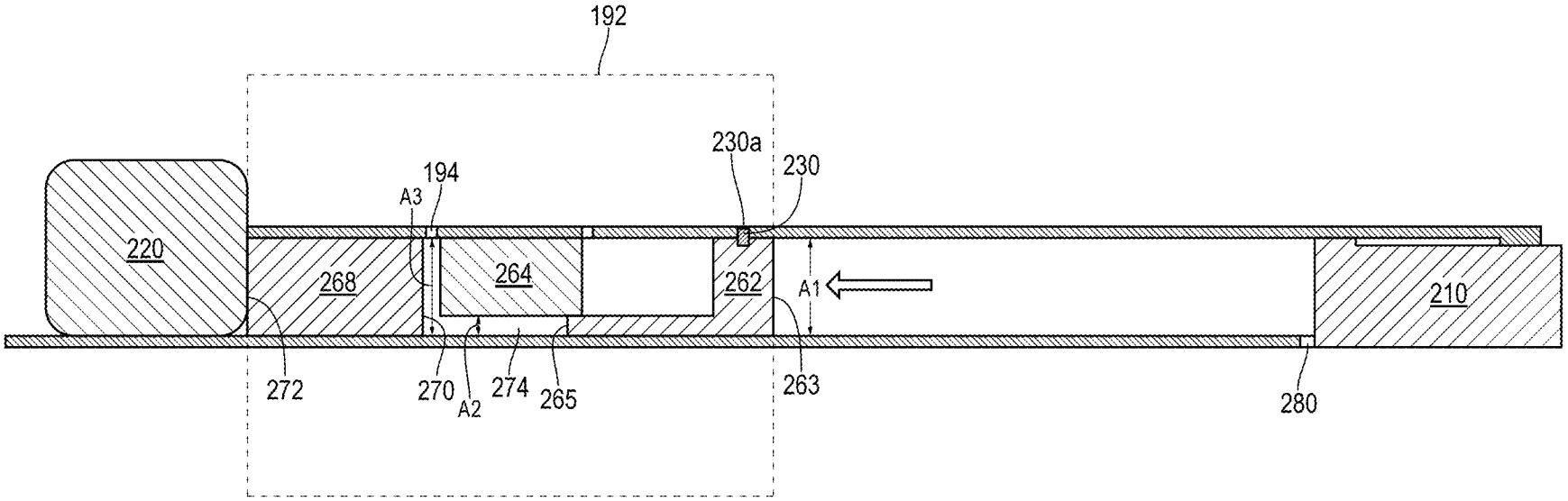
FIG. 3 is a quarter section views of deployment states of an example sealing assembly that may be used in the example well system of FIG. 1, according to aspects of the present disclosure.

FIGS. 3-5 are quarter section views of deployment states of an example sealing assembly that may be used in the example well system of FIG. 1, according to aspects of the present disclosure. In the example shown in FIG. 3, fluid enters from the internal diameter of the tubing through setting port 280 and applies a pressure P1 against the first pressure receiving end 263 of first piston 262. As can be seen in the example shown in FIG. 3, the first piston 262 is physically coupled to the piston cylinder 264 through disengagement system 230. In one example approach, disengagement system 230 is a mechanism that physically couples the first piston to piston cylinder 264 up until the time that enough pressure is applied to first piston 262 to cause first piston 262 to disengage from piston cylinder 264 and activate the pressure intensifier. The disengagement system 230 may include one or more of a shear pin, a collet, a rupture disk, a check valve and a restrictor. In the example shown in FIG. 3, disengagement system 230 includes a shear pin 230*a*.

As shown in FIGS. 2-5, in one example approach, the sealing assembly 184 includes a mandrel and a pressure intensifier 192 positioned radially about the mandrel. The pressure intensifier includes the first piston 262, the second piston 268 and the piston cylinder 264. Piston cylinder 264 radially encompasses the first and second pistons.

In one example approach, the first piston 262 includes a first pressure receiving end with a piston surface area (A1) and a first pressure output end with a piston surface area (A2), where A1 is greater than A2. The second piston 268 includes a second pressure receiving end with a piston surface area (A3), where A3 is greater than A2.

The pressure intensifier 192 further includes a fluid chamber and a pressure relief system. The fluid chamber is defined between the first pressure output end of the first piston, the second pressure receiving end of the second piston, and the piston cylinder, the fluid chamber fluidly coupling the first pressure output end of the first piston to the second pressure receiving end of the second piston. The pressure relief system evacuates fluid from the fluid chamber when pressure in the fluid chamber rises above a pressure relief system threshold.

In one example approach, the setting force P1 may be 1000 psi, the disengagement system 230 activation force may be 3000 lbf., A1 and A3 are 3 sq in, and A2 is 1 sq in. Setting pressure (P1) is applied through the tubing 200 into a setting port 280 as shown. As an example, the max setting pressure is 1,000 psi and the element 220 requires a max setting force of 9000 lbf. However, the pressure required to start setting the element 220 is usually very low (e.g., 400 psi). This generates 1,200 lbf (P1×A1) and starts setting the element 220. This force, however, is not sufficient for the disengagement system 230 to activate so the first piston 262 and the piston cylinder 264 move in tandem to start setting the element 220.

Turning to FIG. 4, once the element 220 is sufficiently packed off, the pressure P1 begins to increase to the maximum available setting pressure (e.g., 1,000 psi). From the example shown in FIG. 3, the pressure at the first pressure output end 265 is:

$$P2=P1\times(A3/A2)$$

In addition, since the pressure P1 acts on A1 (3 sq.in), the pressure P1 generates 3,000 lbf of force which in this example is sufficient to activate the disengagement system 230 but is insufficient to set element 220

When disengagement system 230 is activated (as shown in FIG. 4), the first piston 262 is separated from the piston cylinder 264. The 3,000 lbf of shear force is, therefore, transmitted through the first piston 262 onto the first pressure output end 265 that has 1 sq.in piston area (A2) which exerts this force onto a fluid (preferably incompressible fluid to reduce stroke) in fluid chamber 274. Therefore, the pressure generated (P2) on this fluid volume is 3,000 psi.

$$P2=P1\times(A3/A2)=3000\text{ psi}$$

Notice that to the left of the fluid chamber 274 is a second piston 268 with a 3 sq.in piston area (A3). Therefore, the force generated on this piston is 3,000 psi×3 sq.in =9,000 lbf. In a final step, the second piston now exerts a 9,000 lbf of force onto the element 220 providing the final squeeze and enabling a good seal.

As detailed above, a pressure intensifier 192 may be added to a traditional hydraulic setting mechanism to provide higher localized pressures (e.g., for a given applied pressure) than traditionally achievable. These higher localized pressures may, however, lead to equipment issues. For example, sealing assembly 184 may be rated to handle a maximum collapse pressure of 4,000 psi based on the mandrel. If the same tool were to be run in another well where the max setting force (P1) is 1500 psi, now P2=1500×3=4,500 psi. Therefore, the tool cannot be used in the new well without redesigning the mandrel to have higher yield strength or increased thickness.

Referring to FIGS. 2-7, one example approach to preventing overpressure is to incorporate a pressure relief system 194 within the piston cylinder 264 at the second piston area (e.g., fluid chamber 274), in combination with a disengagement system 230 on the piston cylinder 264 at the first piston area. In one such example approach, the disengagement system 230 is a field-adjustable method for determining the force required to activate the amplified pressure chamber between the piston cylinder 264 and the second piston 268. In some example approaches, the pressure relief system 194 may include a rupture disc or a check valve within the pressure-magnified fluid chamber 274. In some such example approaches, the pressure value may be selected in the field during deployment of sealing assembly 184.

In the example above, where the max amplified pressure is 4,500 psi, the pressure relief system 194 may be set, for instance, to activate at 3,100 psi (±100 psi).

FIG. 5 is quarter section view of an example sealing assembly 184 where the pressure relief system 194 has evacuated the fluid from the fluid chamber 274, according to aspects of the present disclosure. In the example approach shown in FIG. 5, when the pressure relief system 194 is activated the fluid within the amplified piston area (fluid chamber 274) is evacuated, preventing further force generation within the amplified piston area. In one example approach, the pressure P2 drops to P1 when the pressure relief system is activated. This will ensure the sealing assembly 184 will always see the same max required setting force even at higher setting pressures within the well. And this will ensure the amplified pressure will not exceed the pressure rating of the tool.

In an alternate scenario where the maximum setting pressure in a different well is 3,000 psi, the tool may be set without requiring an amplified setting force. The disengagement system 230 may be pinned in the field to shear well above 3,000 psi, ensuring that the piston cylinder 264 and the first piston 262 always move together. This also ensures that the tool rating is not exceeded, as the amplified pressure remains inactive. Alternatively, the fluid chamber 274 may be left empty and open to the wellbore so that no pressure amplification can occur even if the disengagement system were to disengage and allow the first piston 262 to move as its movement would only cause fluid movement out of the fluid chamber and not cause a pressure amplification.

In some example approaches, the disengagement system 230 and pressure relief system 194 may be used in combination to allow the same tool to be run in multiple scenarios with the changes made in the field.

In the example approaches of FIGS. 2-7, a fluid chamber 274 is defined between the first pressure output end 265 of the first piston 262 with the smaller piston surface area (A2) and the second pressure receiving end 270 of the second piston 268 with the larger piston surface area (A3). In one or more example approaches, the fluid chamber 274 is filled with an incompressible fluid, such as for example a water-based liquid or oil-based liquid, among others. In one or more example approaches, fluid chamber 274 is filled with the wellbore fluid by having a one-way valve to the tubing or annulus to allow surrounding fluid to enter fluid chamber 274 and equalize pressure with the wellbore but prevent fluid from exiting fluid chamber 274 when the pressure intensifier is activated.

In some example approaches, the pressure intensifier 192 is always fluidly coupled. Accordingly, an application of an applied fluid pressure to the first pressure receiving end 263 of the first piston 262 will result in the application of an intensified fluid pressure at the second pressure receiving end 270 of the second piston 268. Accordingly, this intensified fluid pressure at the second pressure receiving end 270 of the second piston would translate into an intensified force applied to the second pressure receiving end 270 of the second piston 268, and thus to the sealing element 220. In some example approaches second piston 268 includes a sliding element 250 that conveys the force from second piston 268 to sealing element 220, as shown in FIG. 2.

In some example approaches, such as that shown in FIGS. 2-7, the pressure intensifier 192 is a selectively engageable pressure intensifier. Accordingly, the selectively engageable pressure intensifier 192 may be deactivated for a portion of the total stroke length of second piston 268 and then be activated for a remaining portion of the total setting stroke of the second piston 268, as discussed in detail above. For example, the selectively engageable pressure intensifier, in one or more example approaches, is configured to have an initial state physically coupling the first piston 262 to the second piston 268 when subjected to an initial fluid pressure below a threshold fluid pressure (e.g., the pressure required to disengage the disengagement system 230), and is configured to have a subsequent state physically decoupling and fluidly coupling the first piston 262 and the second piston 268 with one another when subjected to a subsequent fluid pressure above the threshold fluid pressure.

In some example approaches, disengagement system 230 may use a collet to make the pressure intensifier 192 selectively engageable. In one such example approach, the collet is configured to set the disengagement system pressure, and thus remain engaged to physically couple the first piston 262 and the piston cylinder 264 when the selectively engageable pressure intensifier 192 is subjected to an initial fluid pressure below the disengagement system pressure, and to disengage to physically decouple and fluidly couple the first piston 262 and the second piston 268 when the collet is subjected to a subsequent fluid pressure above the disengagement system pressure. In other example approaches, a shear pin or other such shear feature may be used instead of the collet. A rupture disk, check valve or flow restrictor may also be used to make the pressure intensifier 192 selectively engageable and the invention described herein may be used in conjunction with any of these approaches.

In one or more example approaches to the pressure intensifier 192 of FIGS. 2-7, the sealing assembly 184 may additionally include one or more one-way checks used to maintain engagement of the components and prevent the sealing element 220 from relaxing over time and/or if the fluid pressure drops. In at least one example approach, the one or more one-way checks may be a series of teeth that allow the sliding element 250 to slide one way (e.g., to the left in the example approaches shown in FIGS. 2-7), but not the other way (e.g., to the right in the approaches shown in FIGS. 2-7). In yet another example approach, the one or more one-way checks include one or more body lock rings, or one or more slips, etc. In yet another example approach, the one or more one-way checks include a fluid check valve that allows fluid to exit the intensifier 192 but not to re-enter the intensifier 192.

In the example approaches of FIGS. 2-7, FIG. 2 illustrates the downhole tool as a sealing assembly 184 as it might exist in a run-in-hole state. FIG. 3, however, illustrates the sealing assembly 184 as it might exist after applying an initial fluid to setting port 280, the initial fluid having an initial fluid pressure below the threshold disengagement system pressure. The initial fluid application may, in one or more example approaches, move the sliding element 250 a majority of its total setting stroke. Furthermore, since the initial fluid is below the disengagement system pressure, the first piston 262 and the piston cylinder 264 remain physically coupled to one another (e.g., via the collet, for example) while being subjected to this initial fluid pressure. Accordingly, the pressure intensifier feature is deactivated at this time. FIGS. 4-7 illustrate the downhole tool after the initial pressure on the first piston passes above the disengagement system pressure.

Figure 6:
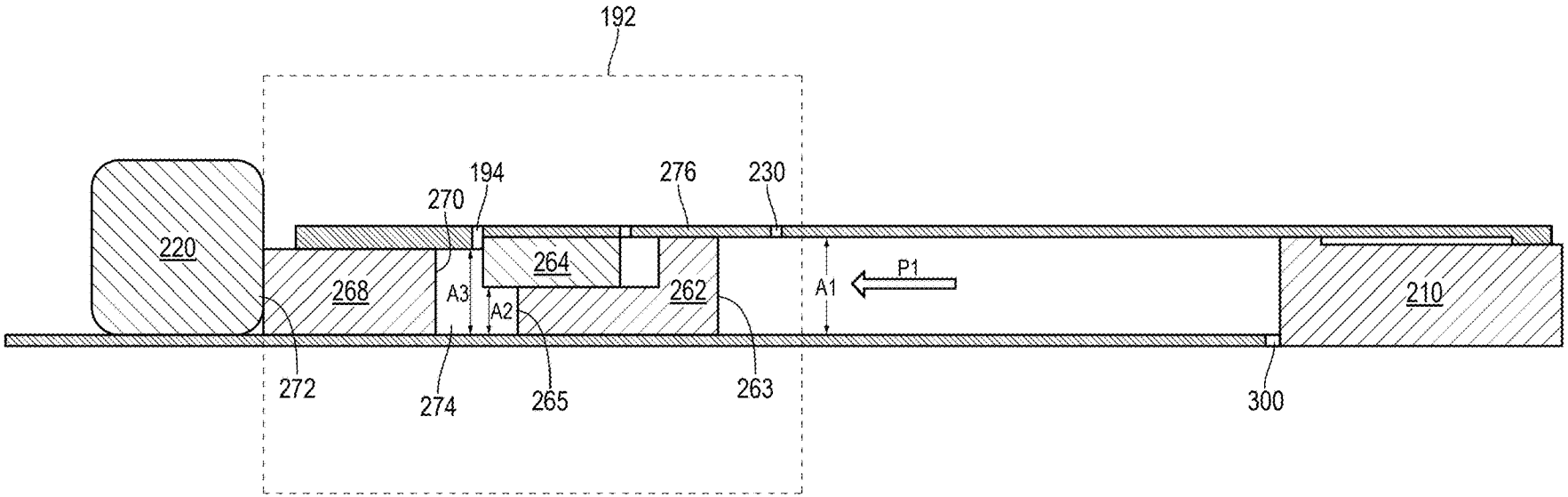
FIG. 6 is a quarter section view of a deployment state of an example sealing assembly that may be used in the example well system of FIG. 1, according to aspects of the present disclosure.

FIG. 6 is a quarter section view of a deployment state of an example sealing assembly that may be used in the example well system of FIG. 1, according to aspects of the present disclosure. As noted above, the first pressure output end 265 of the first piston 262 having the smaller surface area (A2) may be fluidly coupled to the second piston 268 having a second larger surface area (A3), for example via an incompressible fluid. The parameters of A1, A2 and A3 may be tuned to a desired amount of pressure intensification and force output. The greater the ratio of A2 to A1, the higher the pressure intensification. The ratio of A3 to A2 will determine the force generated by this intensified pressure. These relationships may be leveraged to change the amplified pressure of sealing assembly 184 through a modular approach. In one example, for instance, the max setting force needed by the elements may be approximately 5,000 lbf. Given P2 reaches 3,000 psi, while not exceeding the maximum tool rating, this will create a max setting force of 9,000 lbf, exceeding the max setting force needed for the element 220.

To address this, in one example approach, such as shown in FIG. 6, piston cylinder 264 and first piston 262 are modified to create a new A2 and A3 such that A1≠A3. This changes the output force based on the calculations shown below:

$$P1 = 1000 \text{ psi}$$

$$A1 = 3 \text{ square inch}$$

$$A2 = 1.5 \text{ square inch}$$

$$A3 = 2.5 \text{ square inch}$$

$$P1 * A1 = P2 * A2$$

leaving P2=1000*(3/1.5) or 2,000 psi and the new maximum setting force of P2=P2*A3=2000*2.5 or 5,000 lbf.

As such the max tool ratings and max setting force required may be met by varying the ratios of A1, A2 and A3. In one example, the proposed pressure intensifier 192 may be modular and may include a modular piston cylinder 264 and a modular first piston 262. The modules may be designed for multiple applications chosen in the field. In another example approach, the proposed modular pressure intensifier 192 includes a modular piston cylinder 264, a modular first piston 262, a modular second piston 268 and a modular mandrel 210. One or more of the modular piston cylinders 264, the modular first piston 262, the modular second piston 268 and the modular mandrel 210 may be separated from the modular pressure intensifier 192 and replaced with pre-defined modules necessary to achieve the desired amplified power.

Figure 7:
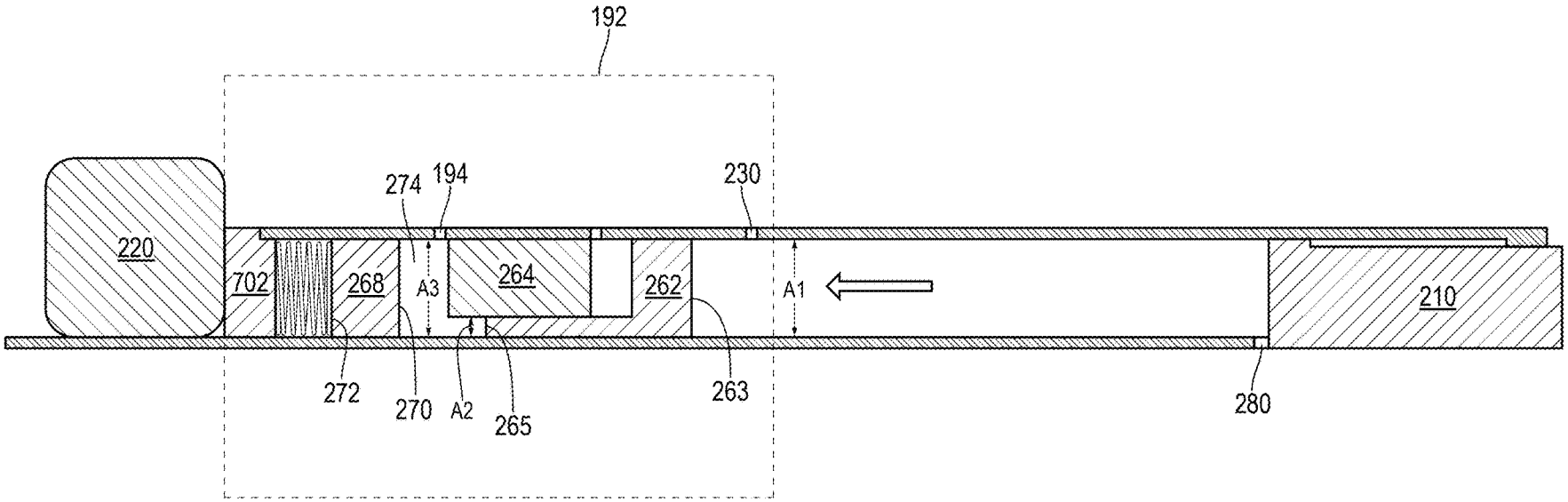
FIG. 7 is a quarter section view of a deployment state of an example sealing assembly that may be used in the example well system of FIG. 1, according to aspects of the present disclosure.

FIG. 7 is a quarter section view of a deployment state of an example sealing assembly that may be used in the example well system of FIG. 1, according to aspects of the present disclosure. In the example approach of FIG. 7, element 220 is energized in scenarios such as a thermal cooldown where the element 220 may lose some of its squeeze. In one example approach, a spring 700 may be assembled between the second piston 268 and a third piston 702. In one such example approach, a lock ring (not shown) may be assembled underneath the third piston 702. In the example shown in FIG. 7, regardless of whether the pressure intensifier 192 is activated, the setting force P2 will compress the spring 700 and set the element 220. (If the pressure intensifier is not activated, the force on the spring 700 and on element 220 will be approximately P1*A1. If the pressure intensifier is activated, the force on the spring 700 and on element 220 will be P2*A3, where P2=P1*(A1/A2).)

In a scenario such as a thermal cooldown where the element may lose some of its sealing, the spring 700 may release a portion of its energy and add squeeze to the elements 220 by transmitting load through the third piston 702. Assembling the components in this manner means that this additional squeeze will be permanently locked into the elements via the lock ring. In this embodiment, not only is a high setting force obtained whilst minimizing the input setting pressure and optimizing the overall length of the downhole tool, but this high setting force is permanently stored in the spring after the setting process is complete and is imparted permanently to the sealing element 220 in case of need. Without this, one would need to stack multiple pistons in series on a downhole tool to get the same output force.

Figure 8:
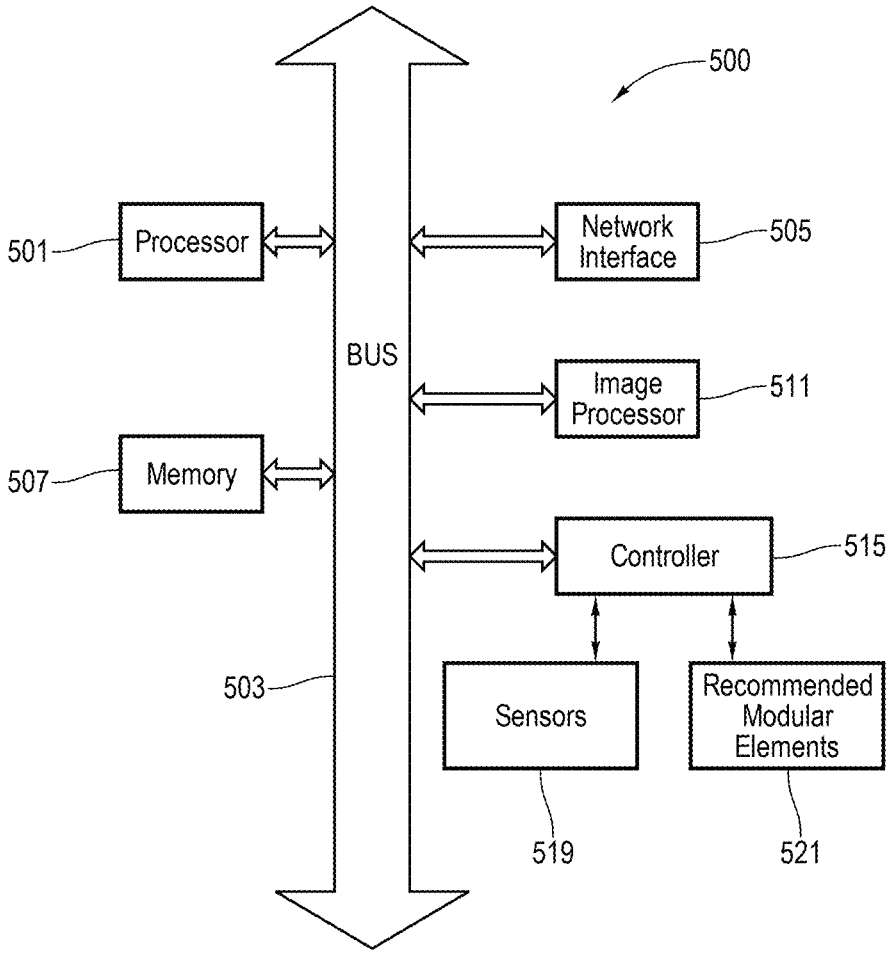
FIG. 8 is a block diagram illustrating a computer system that may be used as part of the system and method for determining amplified pressure P2 in the example well system of FIGS. 1, 2 and 5, according to aspects of the present disclosure.

FIG. 8 is a block diagram illustrating a computer system that may be used as part of the system and method for determining amplified pressure P2 in the example well system of FIGS. 1, 2 and 5, according to aspects of the present disclosure. Computer system 500 may be employed to practice the concepts, methods, and techniques disclosed herein, and variations thereof. In one example approach, computer system 500 includes a plurality of components in electrical communication with each other, in some examples using a bus 503. The computing system 500 may include any suitable computer, controller, or data processing apparatus capable of being programmed to carry out the method and apparatus as further described herein.

In one example approach, computing system 500 may be a general-purpose computer, and may include a processor 501 (possibly including multiple processors, multiple cores, multiple nodes, and/or implementing multi-threading, etc.). In one such example approach, computer system 500 includes a memory 507. The memory 507 may be system memory (e.g., one or more of cache, static random-access memory (SRAM), or dynamic random-access memory (DRAM) or any one or more of the possible realizations of machine-readable media. Computer system 500 also includes bus 503 (e.g., PCI, ISA, PCI-Express, etc.) and a network interface 505 (e.g., ethernet or Fiber Channel).

The computer may also include an image processor 511 and a controller 515. The controller 515 may control the different operations that can occur in response to data received at sensor inputs 519 and/or calculations based on data received from a controller establishing parameters of the pressure intensifier 192 using any of the techniques described herein, and any equivalents thereof. In some example approaches, controller 515 may communicate instructions to the appropriate equipment, devices, etc. used to select a desired amplified pressure P2, an appropriate pressure P2 and one or more of A1, A2, and A3. Any one of the previously described functions may be partially (or entirely) implemented in hardware and/or on the processor 501. For example, the functions may be implemented with an application specific integrated circuit, in logic implemented in the processor 501, in a co-processor on a peripheral device or card, etc. Further, realizations may include fewer or additional components not illustrated in FIG. 8 (e.g., video cards, audio cards, additional network interfaces, peripheral devices, etc.). As illustrated in FIG. 8, the processor 501 and the network interface 505 are coupled to the bus 503. Although illustrated as also being coupled to the bus 503, the memory 507 may be coupled to the processor 501 only, to both processor 501 and bus 503 or to processor 501, image processor 511 and bus 503. Controller 515 may include circuitry, such as analog-to-digital (A/D) converters and buffers that allow controller 515 to receive electrical signals directly from one or more sensor inputs 519.

In one example approach, processor 501 may be configured to execute instructions that provide control over the drilling and calibration procedures described in this disclosure, and over any equivalents thereof. For example, processor 501 may control operations of the pressure intensifier during deployment of a sealing element 220.

With respect to computing system 500, basic features here may easily be substituted for improved hardware or firmware arrangements as they are developed. In some examples, memory 507 includes non-volatile memory and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, may be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 500 or as a general-purpose computer, some example approaches can be any type of device or apparatus to perform operations described herein.

Example Operations

Figure 9:
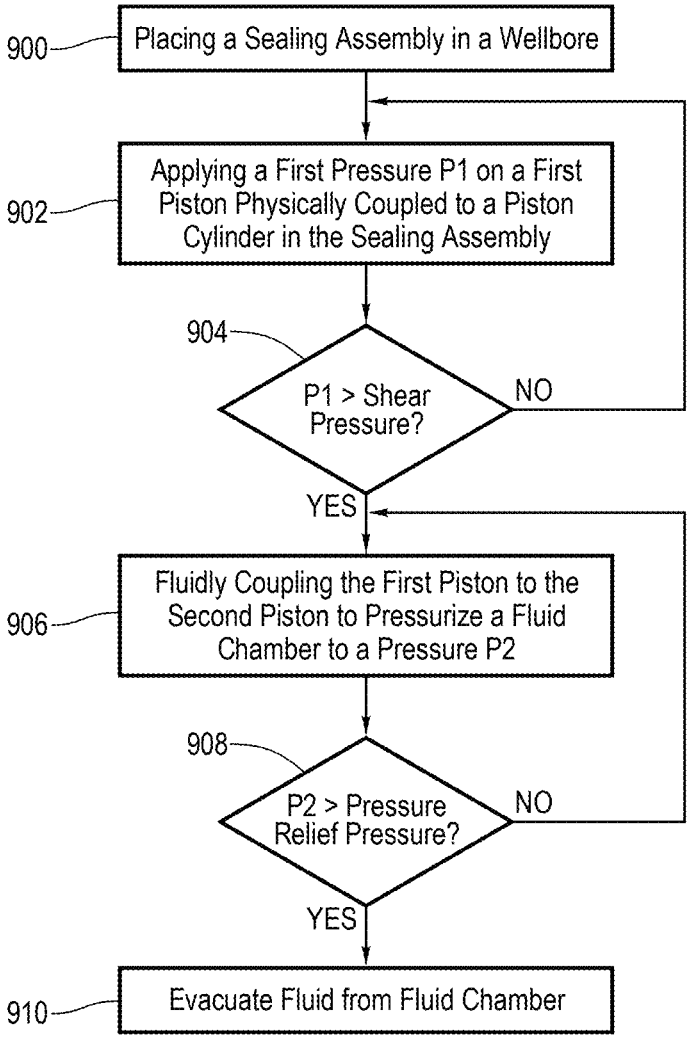
FIG. 9 is a flow chart illustrating a method of deploying a sealing assembly, according to aspects of the present disclosure.

FIG. 9 is a flow chart illustrating a method of deploying a sealing assembly, according to aspects of the present disclosure. In one example approach, a sealing assembly is deployed in a wellbore (900). A first pressure P1 is applied to a first piston physically coupled to a piston cylinder in a pressure intensifier of the sealing assembly (902). If the Pressure P1 is less than the shear force of the disengagement system (904, NO), the pressure P1 is applied to the first piston and, through the first piston, to the piston cylinder (902). Otherwise, the disengagement system shears (904, YES) and fluidly couples the first piston to the second piston, pressurizing a fluid chamber disposed by the second piston to an amplified pressure P2 (906). If the pressure P2 is not greater than a pressure relief pressure (908, NO), the pressure intensifier continues to apply an amplified pressure to the fluid chamber disposed by the second piston (906). If, however, the pressure P2 is greater than a pressure relief pressure (908, YES), the pressure relief system evacuates the fluid from the fluid chamber (920).

Various modifications to the implementations described in this disclosure may be readily apparent to people who have ordinary skill in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

The iterative method described in this disclosure may be extended beyond drilling and applied to other contact problems such as those between a flexible beam/column/pipe/string and rigid constraints (such as drill string-wellbore wall contacts, drill string-riser string contacts, casing-wellbore wall contacts, sucker rod-casing contacts).

Additionally, various features that are described in this specification in the context of separate implementations also can be implemented in a single implementation. Conversely, various features that are described in the context of a single implementation also can be implemented in multiple implementations separately or in any suitable subcombination. As such, although features may be described above as acting in particular combinations, and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one or more example processes in the form of a flowchart or flow diagram. However, other operations that are not depicted can be incorporated in the example processes that are schematically illustrated. For example, one or more additional operations can be performed before, after, simultaneously, or between any of the illustrated operations. In some circumstances, multitasking and parallel processing may be advantageous. Moreover, the separation of various system components in the implementations described above should not be understood as requiring such separation in all implementations, and it should be understood that the described program components and systems can generally be integrated together into a single software product or packaged into multiple software products. Additionally, other implementations are within the scope of the following claims. In some cases, the actions recited in the claims can be performed in a different order and still achieve desirable results.

Example Embodiments

Embodiment #1: A downhole tool, comprising a mandrel and a pressure intensifier positioned radially about the mandrel, the pressure intensifier including a first piston having a first pressure receiving end with a piston surface area (A1) and a first pressure output end with a piston surface area (A2), where A1 is greater than A2; a second piston having a second pressure receiving end with a piston surface area (A3), where A3 is greater than A2; a piston cylinder radially encompassing the first and second pistons; a fluid chamber defined between the first pressure output end of the first piston, the second pressure receiving end of the second piston, and the piston cylinder, the fluid chamber fluidly coupling the first pressure output end of the first piston to the second pressure receiving end of the second piston; and a pressure relief system, wherein the pressure relief system evacuates fluid from the fluid chamber when pressure in the fluid chamber rises above a pressure relief system threshold.

Embodiment #2: The downhole tool of claim 1, wherein the pressure relief system evacuates the fluid from the fluid chamber through the piston cylinder.

Embodiment #3: The downhole tool of claim 1, wherein the second piston is coupled to a sliding element.

Embodiment #4: The downhole tool of claim 1, wherein the piston cylinder includes a disengagement system that physically couples the first piston to the piston cylinder below a disengagement system pressure and fluidly couples the second piston to the first piston above the disengagement system pressure.

Embodiment #5: The downhole tool of claim 1, wherein the pressure intensifier is a selectively engageable pressure intensifier, the selectively engageable pressure intensifier including a disengagement system, the disengagement system configured to have an initial state physically coupling the first piston and the piston cylinder with one another when subjected to an initial fluid pressure below a disengagement system pressure, and configured to have a subsequent state physically decoupling and fluidly coupling the first piston and the second piston with one another when subjected to a subsequent fluid pressure above the disengagement system pressure.

Embodiment #6: The downhole tool of claim 5, wherein the disengagement system includes a collet connected to the piston cylinder, the collet configured to establish the disengagement system pressure.

Embodiment #7: The downhole tool of claim 5, wherein the disengagement system includes a shear pin physically connecting the first piston to the piston cylinder, the shear pin configured to establish the disengagement system pressure.

Embodiment #8: The downhole tool of claim 5, wherein the disengagement system includes one or more of a rupture disk, a relief valve and a restrictor.

Embodiment #9: The downhole tool of claim 1, wherein the tool further includes an elastomeric sealing element, and wherein the second piston applies force on the elastomeric sealing element.

Embodiment #10: The downhole tool of claim 1, wherein the tool further includes an elastomeric sealing element, wherein the pressure intensifier further includes a spring and a third piston, wherein the spring is disposed between the second piston and the third piston, and wherein the third piston acts on the elastomeric sealing element.

Embodiment #11: The downhole tool of claim 1, wherein one or more of A1 and A3 are selected to provide a desired amplified pressure.

Embodiment #12: A well system having a wellbore located in a subterranean formation and a downhole tool positioned in the wellbore, the downhole tool including a mandrel; a pressure intensifier positioned radially about the mandrel the pressure intensifier including a first piston having a first pressure receiving end with a piston surface area (A1) and a first pressure output end with a piston surface area (A2), where A1 is greater than A2; a second piston having a second pressure receiving end with a piston surface area (A3), where A3 is greater than A2; a piston cylinder radially encompassing the first and second pistons; a fluid chamber defined between the first pressure output end of the first piston, the second pressure receiving end of the second piston, and the piston cylinder, the fluid chamber fluidly coupling the first pressure output end of the first piston to the second pressure receiving end of the second piston; and a pressure relief system, wherein the pressure relief system evacuates fluid from the fluid chamber when pressure in the fluid chamber rises above a pressure relief system threshold.

Embodiment #13: The well system of claim 12, wherein the pressure relief system evacuates the fluid from the fluid chamber through the piston cylinder.

Embodiment #14: The well system of claim 12, wherein the piston cylinder includes a disengagement system that physically couples the first piston to the piston cylinder below a disengagement system pressure and fluidly couples the second piston to the first piston above the disengagement system pressure.

Embodiment #15: The well system of claim 12, wherein the pressure intensifier is a selectively engageable pressure intensifier, the selectively engageable pressure intensifier including a disengagement system, the disengagement system configured to have an initial state physically coupling the first piston and the piston cylinder with one another when subjected to an initial fluid pressure below a disengagement system pressure, and configured to have a subsequent state physically decoupling and fluidly coupling the first piston and the second piston with one another when subjected to a subsequent fluid pressure above the disengagement system pressure.

Embodiment #16: The well system of claim 12, wherein the downhole tool further includes an elastomeric sealing element, wherein the pressure intensifier further includes a spring and a third piston, wherein the spring is disposed between the second piston and the third piston, and wherein the third piston acts on the elastomeric sealing element.

Embodiment #17: A method comprising selecting a first pressure P1 for a downhole tool positioned in a wellbore, the downhole tool including a mandrel; and a pressure intensifier positioned radially about the mandrel the pressure intensifier including a first piston having a first pressure receiving end with a piston surface area (A1) and a first pressure output end with a piston surface area (A2), where A1 is greater than A2; a second piston having a second pressure receiving end with a piston surface area (A3), where A3 is greater than A2; a piston cylinder radially encompassing the first and second pistons; a fluid chamber defined between the first pressure output end of the first piston, the second pressure receiving end of the second piston, and the piston cylinder, the fluid chamber fluidly coupling the first pressure output end of the first piston to the second pressure receiving end of the second piston; and a pressure relief system, wherein the pressure relief system evacuates fluid from the fluid chamber when pressure in the fluid chamber rises above a pressure relief system threshold, selecting a second pressure P2, wherein P2 is not equal to P1; and replacing the first piston with a replacement piston, the replacement piston for generating the second pressure P2, wherein the replacement piston has a pressure receiving end with a piston surface area (A4) and a pressure output end with a piston surface area (A5), where a ratio of A4 to A5 is not equal to a ratio of A1 to A2.

Embodiment #18: The method of claim 17, wherein the A1 is not equal to A3.

Embodiment #19: The method of claim 17, wherein the second pressure P2 is a max setting force.

Embodiment #20: The method of claim 17, wherein the second pressure P2 is less than a collapse pressure for the mandrel.

What is claimed is:

1. A downhole tool, comprising:

a mandrel; and a pressure intensifier positioned radially about the mandrel, the pressure intensifier including:

a first piston having a first pressure receiving end with a piston surface area (A1) and a first pressure output end with a piston surface area (A2), where A1 is greater than A2;

a second piston having a second pressure receiving end with a piston surface area (A3), where A3 is greater than A2;

a piston cylinder radially encompassing the first and second pistons, wherein the piston cylinder includes a first piston cylinder section sized for the first pressure receiving end of the first piston, a second piston cylinder section sized for the first pressure output end of the first piston and a third piston cylinder section contiguous with the second piston cylinder section, the third piston cylinder section sized for the second pressure receiving end of the second piston;

a fluid chamber defined between the first pressure output end of the first piston, the second pressure receiving end of the second piston, and the piston cylinder, the fluid chamber fluidly coupling the first pressure output end of the first piston to the second pressure receiving end of the second piston; and a pressure relief system, wherein the pressure relief system evacuates fluid from the fluid chamber when pressure in the fluid chamber rises above a pressure relief system threshold.

2. The downhole tool of claim 1, wherein the pressure relief system evacuates the fluid from the fluid chamber through the piston cylinder.

3. The downhole tool of claim 1, wherein the second piston is coupled to a sliding element.

4. The downhole tool of claim 1, wherein the piston cylinder includes a disengagement system that physically couples the first piston to the piston cylinder below a disengagement system pressure and fluidly couples the second piston to the first piston above the disengagement system pressure.

5. The downhole tool of claim 1, wherein the pressure intensifier is a selectively engageable pressure intensifier, the selectively engageable pressure intensifier including a disengagement system, the disengagement system configured to have an initial state physically coupling the first piston and the piston cylinder with one another when subjected to an initial fluid pressure below a disengagement system pressure, and configured to have a subsequent state physically decoupling and fluidly coupling the first piston and the second piston with one another when subjected to a subsequent fluid pressure above the disengagement system pressure.

6. The downhole tool of claim 5, wherein the disengagement system includes a collet connected to the piston cylinder, the collet configured to establish the disengagement system pressure.

7. The downhole tool of claim 5, wherein the disengagement system includes a shear pin physically connecting the first piston to the piston cylinder, the shear pin configured to establish the disengagement system pressure.

8. The downhole tool of claim 5, wherein the disengagement system includes one or more of a rupture disk, a relief valve and a restrictor.

9. The downhole tool of claim 1, wherein the tool further includes an elastomeric sealing element, and wherein the second piston applies force on the elastomeric sealing element.

10. The downhole tool of claim 1, wherein the tool further includes an elastomeric sealing element, wherein the pressure intensifier further includes a spring and a third piston, wherein the spring is disposed between the second piston and the third piston, and wherein the third piston acts on the elastomeric sealing element.

11. The downhole tool of claim 1, wherein one or more of A1 and A3 are selected to provide a desired amplified pressure.

12. A well system, comprising:

a wellbore located in a subterranean formation; and a downhole tool positioned in the wellbore, the downhole tool including:

a mandrel;

a pressure intensifier positioned radially about the mandrel the pressure intensifier including:

a first piston having a first pressure receiving end with a piston surface area (A1) and a first pressure output end with a piston surface area (A2), where A1 is greater than A2;

a second piston having a second pressure receiving end with a piston surface area (A3), where A3 is greater than A2;

a piston cylinder radially encompassing the first and second pistons, wherein the piston cylinder includes a first piston cylinder section sized for the first pressure receiving end of the first piston, a second piston cylinder section sized for the first pressure output end of the first piston and a third piston cylinder section contiguous with the second piston cylinder section, the third piston cylinder section sized for the second pressure receiving end of the second piston;

a fluid chamber defined between the first pressure output end of the first piston, the second pressure receiving end of the second piston, and the piston cylinder, the fluid chamber fluidly coupling the first pressure output end of the first piston to the second pressure receiving end of the second piston; and a pressure relief system, wherein the pressure relief system evacuates fluid from the fluid chamber when pressure in the fluid chamber rises above a pressure relief system threshold.

13. The well system of claim 12, wherein the pressure relief system evacuates the fluid from the fluid chamber through the piston cylinder.

14. The well system of claim 12, wherein the piston cylinder includes a disengagement system that physically couples the first piston to the piston cylinder below a disengagement system pressure and fluidly couples the second piston to the first piston above the disengagement system pressure.

15. The well system of claim 12, wherein the pressure intensifier is a selectively engageable pressure intensifier, the selectively engageable pressure intensifier including a disengagement system, the disengagement system configured to have an initial state physically coupling the first piston and the piston cylinder with one another when subjected to an initial fluid pressure below a disengagement system pressure, and configured to have a subsequent state physically decoupling and fluidly coupling the first piston and the second piston with one another when subjected to a subsequent fluid pressure above the disengagement system pressure.

16. The well system of claim 12, wherein the downhole tool further includes an elastomeric sealing element, wherein the pressure intensifier further includes a spring and a third piston, wherein the spring is disposed between the second piston and the third piston, and wherein the third piston acts on the elastomeric sealing element.

17. A method, comprising:

selecting a first pressure P1 for a downhole tool positioned in a wellbore, the downhole tool including:

a mandrel; and a modular pressure intensifier positioned radially about the mandrel the pressure intensifier including:

a modular first piston having a first pressure receiving end with a piston surface area (A1) and a first pressure output end with a piston surface area (A2), where A1 is greater than A2;

a second piston having a second pressure receiving end with a piston surface area (A3), where A3 is greater than A2;

a modular piston cylinder radially encompassing the first and second pistons, wherein the modular piston cylinder includes a first piston cylinder section sized for the first pressure receiving end of the first piston, a second piston cylinder section sized for the first pressure output end of the first piston and a third piston cylinder section contiguous with the second piston cylinder section, the third piston cylinder section sized for the second pressure receiving end of the second piston;

a fluid chamber defined between the first pressure output end of the first piston, the second pressure receiving end of the second piston, and the piston cylinder, the fluid chamber fluidly coupling the first pressure output end of the first piston to the second pressure receiving end of the second piston; and a pressure relief system, wherein the pressure relief system evacuates fluid from the fluid chamber when pressure in the fluid chamber rises above a pressure relief system threshold, selecting a second pressure P2, wherein P2 is not equal to P1; and replacing the first piston with a replacement piston and the second piston cylinder section with a replacement piston cylinder section sized for the pressure output end of the replacement piston, the replacement piston for generating the second pressure P2, wherein the replacement piston has a pressure receiving end with a piston surface area (A4) and a pressure output end with a piston surface area (A5), where a ratio of A4 to A5 is not equal to a ratio of A1 to A2.

18. The method of claim 17, wherein the A1 is not equal to A3.

19. The method of claim 17, wherein the second pressure P2 is a max setting force.

20. The method of claim 17, wherein the second pressure P2 is less than a collapse pressure for the mandrel.

* * * * *